United States Patent [19]

Carlson

[11] 4,222,833

[45] Sep. 16, 1980

[54] SNIFF GAS RECOVERY METHOD

[75] Inventor: Gordon A. Carlson, Wadsworth, Ohio

[73] Assignee: PPG Industries, Inc., Pittsburgh, Pa.

[21] Appl. No.: 73,829

[22] Filed: Sep. 10, 1979

[51] Int. Cl.[3] ..... C25B 1/26

[52] U.S. Cl. ..... 204/128; 204/130

[58] Field of Search ..... 204/128, 130

[56] References Cited

U.S. PATENT DOCUMENTS

| | | | |
|---|---|---|---|
| 3,102,085 | 8/1963 | Edwards et al. | 204/128 |
| 3,692,649 | 9/1972 | Prigent et al. | 204/130 |
| 3,753,881 | 8/1973 | Zabolotny et al. | 204/130 |
| 3,793,171 | 2/1974 | Zabolotny et al. | 204/130 |
| 4,069,117 | 1/1978 | Cooper | 204/128 |

*Primary Examiner*—R. L. Andrews

*Attorney, Agent, or Firm*—Richard M. Goldman

[57] ABSTRACT

Disclosure is a method of treating a chlorine containing first gas stream in an electrolytic cell having an aqueous hydrochloride acid catholyte liquor containing catholyte compartment, an aqueous hydrochloric acid anolyte liquor containing anolyte compartment and an ion permeable barrier therebetween. According to the disclosed method the first gas stream is fed to the catholyte compartment, and an electrical current is passed through the cell to form chloride ion in the catholyte liquor. The first gas stream, depleted in chlorine content, is recovered from the catholyte compartment, while a second gas stream, containing mainly chlorine is recovered from the anolyte compartment.

11 Claims, 1 Drawing Figure

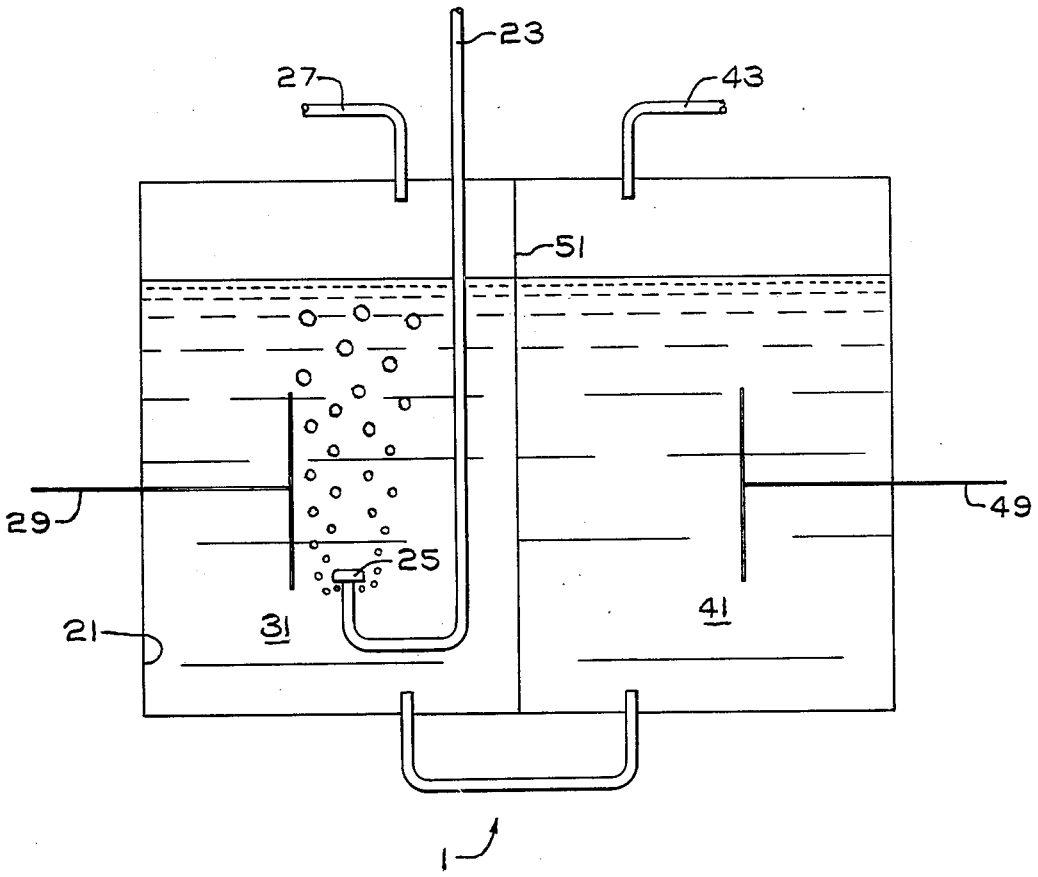
23
27
43
51
29
49
25
21
31
41
1

SNIFF GAS RECOVERY METHOD

DESCRIPTION OF THE INVENTION

This invention relates to the removal and recovery of chlorine from gases containing impure chlorine, from about 1 to about 80 weight percent chlorine and preferably up to about 20 weight percent chlorine in order to recover the chlorine therefrom. These gas streams may arise from chlorine manufacture, e.g., as the noncondensible fraction of gases from chlorine manufacture after passage through a compressor-condensor train. These streams contain nitrogen, oxygen, and chlorine, where the nitrogen and oxygen are referred to as noncondensibles. These gas streams may also arise from sniff gas streams, e.g., for example from empty chlorine tank cars, empty chlorine tank barges and chlorine storage tanks.

The noncondensible gas streams arising from chlorine compression and condensation generally contain from about 10 to about 25 percent chlorine, depending upon the pressure of the compressors, the interstage cooling efficiency and the condensation temperature.

Sniff gas from empty tank cars, empty tank barges, empty storage tanks generally contains from about 10 to about 80 percent chlorine.

It is to be understood that the above percentages represent only approximate ranges of the chlorine containing gas streams encountered in the practice of this invention, and that gases with significantly higher and significantly lower chlorine contents may be processed for removal and recovery of chlorine therefrom.

Previously these gas streams have been treated for the removal and the recovery of the chlorine by passing the gas streams through an alkaline solution, for example, an alkali metal hydroxide solution, or an alkali metal carbonate solution, whereby to form alkali metal chloride, or through sulfur chloride, $S_2Cl_2$, or carbon tatrachloride. Alternatively, chlorine has been removed, especially when the gas streams only contain certain trace amounts of chlorine, by passing the gas stream through activated carbon, charcoal or the like.

It has now been found that the chlorine may be removed from a chlorine containing gas stream and recovered therefrom by passing the gas stream through the catholyte compartment of an electrolytic cell where the catholyte compartment contains a suitable catholyte liquor, and where the cell further includes an anolyte compartment containing a suitable anolyte liquor, and an ion permeable barrier therebetween. In the contemplated process a first gas stream from which chlorine is to be removed, is fed to the catholyte compartment of the electrolytic cell. An electrical current is caused to pass through the cell thereby to form chloride ion in the catholyte liquor. The first gas stream depleted in chlorine content is recovered from the catholyte compartment, while a second gas stream, containing chlorine at a higher chlorine content than the first gas stream fed to the catholyte compartment, is recovered from the anolyte compartment.

THE FIGURE

The FIGURE shows a flow chart for one exemplification of the process described herein.

DETAILED DESCRIPTION OF THE INVENTION

As herein contemplated a chlorine containing first gas stream is fed to the catholyte compartment of an electrolytic cell. The chlorine is bubbled through the catholyte liquor in proximity to the cathode, for example, by feeding the chlorine containing first gas stream to the catholyte liquor so as to provide a high degree of chlorine-elecrolyte-electrode contact.

The catholyte liquor and the anolyte liquor should be the same chemical species. The electrolyte should yield chlorine at an anode. Preferably the electrolyte is an aqueous electrolyte, and in a particularly preferred embodiments, one where other cations do not interfere with chloride ion formation at the cathode. In a particularly preferred exemplification the electrolyte is aqueous hydrochloric acid containing from 20 to about 30 weight percent hydrogen chloride. While the invention is described with respect to aqueous hydrochloric acid electrolytes it is to be understood that other electrolytes may be used interchangeably therewith.

Especially preferred are those electrolytes which when electrolyzed do not yield oxygen.

An electrical potential is externally imposed across the cell whereby to cause the electrical current to pass through the cell. Chloride ion is formed at the cathode by the reaction:

$$Cl_2+2e^- \rightarrow 2Cl^-$$

Chlorine is formed at the anode by the reaction:

$$2CL^- \rightarrow Cl_2+2e^-$$

The first gas stream is recovered from the catholyte compartment, depleted in chlorine content, as described above. A second gas stream is recovered from the anolyte compartment. This second gas stream is a chlorine containing stream. In a preferred exemplification it contains substantially pure chlorine, that it has a higher chlorine concentration than the first gas stream which is fed to the catholyte compartment. In this way chlorine of higher concentration, e.g., substantially pure chlorine, is recovered in the second gas stream from the chlorine-containing first gas stream.

The net result of the above reactions is a build-up of chloride ion in the catholyte liquor and a diminution of chloride ion in the anolyte liquor. In order to maintain electrical neutrality while forming chloride ion in the catholyte and evolving chlorine in the anolyte, it is necessary to transfer hydrogen ion from the anolyte to the catholyte, and to transfer chloride ion from the catholyte to the anolyte. Moreover, mixing of the impure gas feed and pure chlorine product must be avoided.

These ends may be accomplished by (1) allowing free mixing of the electrolytes while providing a gas barrier between the anode and the cathode, or (2) by providing an electrolyte permeable diaphragm between the anolyte and the catholyte, with either bulk flow from the anolyte to the catholyte and diffusional flow of chloride ion from the catholyte to the anolyte or bulk flow from the catholyte to the anolyte and diffusional flow of hydrogen ion from the anolyte to the catholyte, or (3) the provision of a cation selective permionic membrane between the anolyte and the catholyte, with the external flow of catholyte liquor to the anolyte compartment and the ionic flow of hydrogen ion through the membrane from the anolyte compartment to the catholyte compartment, or (4) the provision of an anion selective permionic membrane between the anolyte and the catholyte, with ionic flow of chloride ion through the anion selective permionic membrane from the catholyte compartment to the anolyte compartment.

The method of the invention is carried out in an electrolytic cell having a catholyte compartment 21 with a gas feed line 23, means 25 for passing the gas through the electrolyte, such as a bubble cap, diffusor or the like in proximity to the cathode. Alternatively, the first gas stream may be discharged in a hollow cathode, or in a porous cathode. The catholyte compartment includes gas recovery means 27 for recovering gas depleted with chlorine content from the catholyte compartment. There is also provided means for recovering catholyte liquor and means for feeding the electrolyte from the catholyte to the anolyte, i.e., to transfer chloride ions to the anolyte compartment 41.

Within the catholyte compartment 21 is a cathode 29 at which molecular chlorine is reduced to chloride ions. The cathode material should be a material that is capable of high current density electrolysis, for example above 100 amps per square foot and preferably, above 500 or even 1000 amps per square foot, and where the chloride formation overvoltage is such as to prefer chloride ion formation rather than the electrolysis of water e.g., to form oxygen containing ions.

The cathode 29 may be a porous valve metal with an electro catalytic surface thereon, or porous carbon, for example as prepared by contacting the carbon with nitric acid, heating the nitric acid treated carbon and thereafter electrolyzing the heated, nitric acid contacted carbon in an oxygen containing atmosphere whereby to oxidize a portion of the carbon.

Alternatively, especially where the electrolyte is concentrated hydrochloric acid as described above, the cathode may be steel, mild steel, stainless steel, coated titanium, or graphite.

The electrolytic cell 1 has an anolyte compartment 41 with a gas recovery line 43, anolyte recovery means, not shown, and an anode 49. The anode 49 should be one at which chloride ion is readily oxidized to molecular chlorine, for example, a valve metal such as titanium, tantalum, tungsten, niobium or the like with a suitable coating, for example a coating of a precious metal, an oxide of a precious metal, a mixed oxide or mixtures of oxide of a precious metal and a valve metal, or a composition of a precious metal, a valve metal and a transition metal, as are well known in the electrolytic chlorine evolution art.

Interposed between the anolyte compartment 21 and the catholyte compartment 41 is an ion permeable separator 51. The ion permeable separator 51 may be an electrolyte permeable separator i.e., a diaphragm, or it may be an electrolyte impermeable separator, i.e., a permionic membrane.

Electrolyte permeable separators, that is, diaphragms, include both asbestos diaphragms and synthetic microporous diaphragms. Asbestos diaphragms may either be preformed sheets, for example asbestos paper, or deposited asbestos diaphragms, for example, deposited from fibrous condition as is well known in the art. Synthetic microporous diaphragms are typically halocarbon sheets or films, for example fluorocarbon sheets or films.

According to a preferred alternative exemplification, the ion permeable separator is electrolyte impermeable. That is, it is either cation selective whereby to allow hydrogen ions to pass from the anolyte 41 to the catholyte 21 while being substantially impermeable to the flow of chloride ions from the catholyte to the anolyte, or it is anion selective whereby to allow chloride ions to pass from the catholyte 21 to the anolyte 41 while being substantially impermeable to the flow of hydrogen ions from the anolyte 41 to the catholyte 21. Preferably, the electrolyte impermeable, ion selective, membrane 51 is an anion selective permionic membrane.

The preferred permionic membranes are halocarbon films, for example, a fluorocarbon film having selective groups thereon. Cation selective groups are pendant acid groups, generally chosen from the group consisting of carboxylic acid groups, sulfonic acid groups, sulfonimides, phosphoric acid groups, phosphonic acid groups, precursors thereof, and reaction products thereof. Anion selective groups are basic groups, as nitrogen containing groups.

In one exemplification, the anode 49 and cathode 29 are both spaced from the ion permeable separator 51 by an amount sufficient to require electrolytic conduction between each of the electrodes 29, 49 and the separator 51. According to an alternative exemplification, either the anodic catalyst 49 or the cathodic catalyst 29 or both of them may be imbedded in a cation selective permionic membrane 51 in a solid polymer electrolyte configuration. In a particularly preferred exemplification of the method of this invention, a solid polymer electrolyte configuration is utilized.

According to one exemplification of this invention the gas stream containing about 10 percent chlorine, about 16 percent oxygen and about 74 percent nitrogen and other noncondensibles, at a temperature of about 25° C. and atmospheric pressure or at an elevated pressure, e.g., a pressure of about 1 to 10 atmospheres gauge, is fed to the aqueous hydrochloric acid catholyte liquor of a solid polymer electrolyte electrolytic cell. An electrical potential is imposed across the cell. A gas containing about 1 percent chlorine, about 17 percent oxygen and about 82 percent nitrogen and other noncondensibles is recovered from the catholyte compartment and a gas containing above about 95 percent chlorine is recovered from the anolyte compartment.

While the invention has been described with specific exemplifications and embodiments thereof, it is to be understood substitutions and equivalents may be made therein and that the scope of the invention is to be limited solely as in the claims appended hereto.

I claim:

1. A method of treating a chlorine containing first gas stream in an electrolytic cell having an aqueous hydrochloric acid catholyte liquor containing catholyte compartment, an aqueous hydrochloric acid anolyte liquor containing anolyte compartment and an ion permeable barrier therebetween, which method comprises:

feeding said first gas stream to the catholyte compartment containing an electrolyte consisting essentially of an aqueous solution of hydrochloric acid;

passing an electrical current through said cell whereby to form chloride ion in the catholyte liquor;

recovering said first gas stream, depleted in chlorine content, from the catholyte compartment; and recovering a second gas stream, having a higher chlorine content than the first gas stream fed to the catholyte compartment, from the anolyte compartment.

2. The method of claim 1 wherein the ion permeable separator is a permionic membrane.

3. The method of claim 2 wherein the permionic membrance is a cation selective permionic membrane, comprising transferring aqueous hydrochloric acid from the catholyte compartment to the anolyte compartment.

4. The method of claim 2 wherein the anode and the cathode are each spaced from the permionic membrane.

5. The method of claim 2 wherein the anode, the cathode and the permionic membrane comprise a solid polymer electrolyte.

6. The method of claim 2 wherein the permionic membrane is an anion selective permionic membrane, and there is substantially no flow of hydrogen ion to the catholyte compartment.

7. The method of claim 6 wherein chloride ion passes through the permionic membrane from the catholyte compartment of the anolyte compartment.

8. The method of claim 1 wherein the ion permeable separator is an electrolyte permeable diaphragm.

9. The method of claim 8 comprising maintaining a hydrostatic head on the cathode side whereby to transport catholyte liquor through the diaphragm.

10. The method of claim 1 wherein the first gas steam is a sniff gas stream.

11. The method of claim 1 wherein the first gas stream is a non-condensible gas stream.

* * * * *